US010632768B2

(12) United States Patent
Takahashi

(10) Patent No.: US 10,632,768 B2
(45) Date of Patent: Apr. 28, 2020

(54) PRINTER

(71) Applicants: CITIZEN WATCH CO., LTD., Nishitokyo-shi, Tokyo (JP); CITIZEN SYSTEMS JAPAN CO., LTD., Nishitokyo-shi, Tokyo (JP)

(72) Inventor: Akira Takahashi, Iida (JP)

(73) Assignees: CITIZEN WATCH CO., LTD., Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 0 days.

(21) Appl. No.: 16/147,022

(22) Filed: Sep. 28, 2018

(65) Prior Publication Data

US 2019/0030924 A1 Jan. 31, 2019

Related U.S. Application Data

(63) Continuation of application No. PCT/JP2017/007244, filed on Feb. 24, 2017.

(30) Foreign Application Priority Data

Mar. 30, 2016 (JP) ..... 2016-069262

(51) Int. Cl.
*B41J 11/70* (2006.01)
*B41J 3/60* (2006.01)
(Continued)

(52) U.S. Cl.
CPC ..... *B41J 11/70* (2013.01); *B41J 3/60* (2013.01); *B41J 13/009* (2013.01); *B41J 15/04* (2013.01); *B65H 16/02* (2013.01); *B65H 29/60* (2013.01)

(58) Field of Classification Search
CPC ..... B41J 11/70; B41J 3/36; B41J 11/00; B41J 3/60; B65H 16/02; B65H 29/60
See application file for complete search history.

(56) References Cited

U.S. PATENT DOCUMENTS 5,328,280 A 7/1994 Ito
5,677,722 A * 10/1997 Park ..... B41J 3/60 347/218

(Continued)

FOREIGN PATENT DOCUMENTS

CN 101898698 A 12/2010
CN 103221222 A 7/2013

(Continued)

OTHER PUBLICATIONS

International Preliminary Report on Patentability issued for corresponding International Patent Application No. PCT/JP2017/007244, dated Oct. 2, 2018, and notification of transmittal of the English translation mailed on Oct. 11, 2018.

(Continued)

*Primary Examiner* — Huan H Tran
(74) *Attorney, Agent, or Firm* — Myers Wolin, LLC

(57) ABSTRACT

A printer is configured that, when double-side recording is executed, a back end side of a long strip-like recording medium on which single-side recording is executed by a recording unit is cut by a cutter mechanism, the cut-off recording medium is thereafter conveyed to an inversion mechanism starting with a front end thereof by a switching flap disposed on a side closer to a discharge outlet than the cutter mechanism, a front side and a back side are inverted to each other at the inversion mechanism, thereafter the recording medium is again conveyed to the recording unit starting with an end thereof that is the back end when the recording medium is conveyed to the inversion mechanism, recording is executed for the back side by the recording unit, thereafter the recording medium is again conveyed to the cutter mechanism, and a margin is cut off by the cutter mechanism.

4 Claims, 13 Drawing Sheets

(51) Int. Cl.

| | |
|---|---|
| ***B65H 16/02*** | (2006.01) |
| ***B65H 29/60*** | (2006.01) |
| ***B41J 13/00*** | (2006.01) |
| ***B41J 15/04*** | (2006.01) |

(56) References Cited

U.S. PATENT DOCUMENTS

| | | | | |
|---|---|---|---|---|
| 8,585,034 | B1 | 11/2013 | Mahoney et al. | |
| 8,599,229 | B1 * | 12/2013 | Mindler | B41J 3/60 347/174 |
| 8,599,230 | B1 * | 12/2013 | Mindler | B41J 3/60 347/174 |
| 8,885,003 | B2 * | 11/2014 | Mindler | B41J 2/325 347/176 |
| 9,108,436 | B1 * | 8/2015 | Yamamoto | B41J 2/325 |
| 9,205,674 | B2 * | 12/2015 | Kamitani | B41J 2/325 |
| 2010/0302298 | A1 | 12/2010 | Moriyama et al. | |
| 2013/0233913 | A1 | 9/2013 | Inoue et al. | |
| 2013/0342626 | A1 | 12/2013 | Mindler et al. | |
| 2015/0231899 | A1 | 8/2015 | Yamamoto et al. | |
| 2015/0246555 | A1 | 9/2015 | Kamitani et al. | |

FOREIGN PATENT DOCUMENTS

| | | | | |
|---|---|---|---|---|
| JP | 2007-144960 | * | 6/2007 | B41J 11/70 |
| JP | 2007144960 | A | 6/2007 | |
| JP | 2008230073 | A | 10/2008 | |
| JP | 2011110789 | A | 6/2011 | |
| JP | 2014129170 | A | 7/2014 | |
| JP | 2015136796 | A | 7/2015 | |
| JP | 2015528757 | A | 10/2015 | |

OTHER PUBLICATIONS

The First Office Action issued by the State Intellectual Property Office of People's Republic of China for corresponding Chinese Patent Application No. 201780016623.X, dated Oct. 25, 2019; full English translation attached.

The extended European search report with supplementary European search report and the European search opinion for corresponding European Patent Application No. 17773947.1, dated Oct. 31, 2019.

Notice of Reasons for Refusal issued by the Japan Patent Office for corresponding Japanese Patent Application No. 2016-069262, dated Jul. 30, 2019, with an English translation.

Notice of Reasons for Refusal issued by the Japan Patent Office for corresponding Japanese Patent Application No. 2016-069262, dated Oct. 8, 2019, with an English translation.

* cited by examiner

PRINTER

CROSS-REFERENCE TO RELATED APPLICATIONS

This is a continuation under 35 U.S.C. § 120 of International Application PCT/JP2017/007244, filed Feb. 24, 2017, which claims priority to JP Application 2016-069262, filed Mar. 30, 2016, the contents of each of which are incorporated by reference herein.

TECHNICAL FIELD

The present invention relates to a printer capable of executing recording to both sides of a recording medium.

BACKGROUND ART

Conventionally, a printer has been present that executes a recording operation for both sides of a recording medium. Such types of printers include a printer that cuts a long strip-like recording medium at a predetermined length for use therein. To realize recording to both sides of the recording medium by a single recording unit, the front side and the back side of the recording medium need to be inverted from each other relative to a position for recording by the recording unit such as a printing head after a recording operation is executed for the front side and before another recording operation is executed for the back side. When the long strip-like recording medium is used, to invert the front side and the back side thereof from each other, the long strip-like recording medium needs to be cut prior to the inversion.

On the other hand, to ensure the precision of the position for the recording, the recording medium needs to be firmly gripped to avoid any displacement of the position of the recording medium during the recording operation. So that gripping marks do not remain on the recording medium after the recording operation, a margin portion outside the print range needs to be gripped during the recording operation and the margin portion needs to be cut off after the recording operation is executed. A printer has therefore traditionally been present that includes two cutters that are a cutter that cuts for the inversion and another cutter that cuts off the margin portion after the double-side recording is completed.

For example, a printer has been traditionally present that includes, at a branching position of three conveyance paths branching into three directions toward a holding unit that holds a long trip-like recording medium wound thereon in a roll, a recording unit that executes a recording operation, and an inversion path that is used to invert the recording medium, a flow diverter that is selectively positioned at a first position to connect the holding unit and the recording unit to each other and the inversion path and the recording unit to each other, and at a second position to connect the holding unit and the inversion path to each other (for example, refer to Patent Document 1 below).

In the printer described in Patent Document 1, after executing printing for the front side of the recording medium conveyed from the holding unit to the recording unit by positioning the flow diverter at the first position, the recording medium is pulled back to the holding unit, the flow diverter is positioned at the second position, and the recording medium to which the printing is executed on the front side thereof is conveyed to the inversion path. When the recording medium is conveyed to the inversion path, the long strip-like recording medium is cut at a predetermined length by the first cutter disposed near the holding unit.

Printing is executed for the back side of the recording medium conveyed from the inversion path to the recording unit by positioning the flow diverter at the first position, and the margin of the recording medium to which the printing is executed on both sides thereof is thereafter cut off by the second cutter.

For example, a printer has been traditionally present that is adapted to convey a long strip-like recording medium to a recording unit to execute printing for a front side of the long strip-like recording medium, thereafter cut the long strip-like recording medium at a predetermined length by a first cutter, bend the cut-off recording medium to transpose the front end and the back end thereof with each other to thereby invert the front side and the back side of the recording medium to each other relative to the position for the recording by the recording unit, execute printing for the back side of the inverted recording medium, and thereafter cut off the recording medium for which the printing is executed for both sides thereof, by a second cutter to discharge the recording medium (see, e.g., Patent Document 2 below).

For example, conventionally, a printer has been present that is adapted to convey a long strip-like recording medium from the side of a discharge outlet to a gap between a thermal head and a platen roller that are disposed to face each other sandwiching therebetween a conveyance path spanning from a holding unit that holds the recording medium wound thereon in a roll to the discharge outlet to execute front side printing, draw back the recording medium for which the front side printing is executed into the holding unit, thereafter convey the recording medium from the side of the holding unit to execute back side printing, and cut the recording medium for which printing is executed for both sides thereof by a cutter to discharge the recording medium (see, e.g., Patent Document 3 below).

Patent Document 1: Published Japanese-Translation of PCT Application, Publication No. 2015-528757

Patent Document 2: Japanese Laid-Open Patent Publication No. 2011-110789

Patent Document 3: Japanese Laid-Open Patent Publication No. 2015-136796

DISCLOSURE OF INVENTION

Problem to be Solved by the Invention

With each of the traditional techniques described in Patent Documents 1 and 2, a problem however arises in that the structure is complicated because the two cutters are included. Jamming tends to occur around the cutter and, for the printer including the two cutters, the frequency of occurrence of jamming is high and associated with this, the frequency of execution of the work to solve the jamming is also high. A problem therefore arises in that the convenience for the worker is poor.

To solve the above problems associated with the traditional techniques, an object of the present invention is to provide a printer capable of facilitating improvement of the convenience for the worker.

Means for Solving Problem

To solve the problems above and achieve an object, a printer according to the present invention is characterized in that the printer includes a recording medium holding unit that holds a long, wound, strip-like recording medium to as to enable the recording medium to be pulled out starting with an outer circumference side thereof; a recording unit that pulls out the recording medium held by the recording medium holding unit to execute a recording operation for the recording medium that is pulled out; a cutting unit that cuts a predetermined position of the recording medium for which the recording operation is executed by the recording unit, at a cutting position disposed closer toward the recording unit than a discharge position at which the recording medium is discharged; an inverting unit that inverts relative to a position for the recording by the recording unit, a front side and a back side of the recording medium for which the recording operation is executed by the recording unit and conveys the recording medium to the recording unit; and a switching unit that switches a conveyance destination of the recording medium passing through the cutting position for cutting by the cutting unit, to the inversion unit or the discharge position.

The printer according to the present invention is further characterized in that in the invention above, the printer further includes a housing that accommodates therein the recording medium holding unit, the recording unit, the cutting unit, the inverting unit, and the switching unit. The cutting unit is disposed near the discharge position at which the recording medium is discharged to an exterior of the housing.

The printer according to the present invention is further characterized in that in the invention above, the switching unit is disposed at a position closer to an outer side of the housing than is the cutting unit.

The printer according to the present invention is further characterized in that in the invention above, the printer further includes a conveyance path that spans from the cutting position to the inverting unit, passes through a side that is lower in a vertical direction than a conveyance path of the recording medium from the recording medium held by the recording medium holding unit and the recording medium holding unit, to the recording unit. The switching unit switches the conveyance destination of the recording medium to the inverting unit by guiding the recording medium passing through the cutting position, to the conveyance path.

Effect of the Invention

According to the printer of the present invention, an occurrence of jamming can be suppressed and, even when jamming occurs, the work to solve the jamming can easily be executed. According to the printer of the present invention, an effect is thereby achieved in that improvement of the convenience for the worker can be facilitated.

BEST MODE(S) FOR CARRYING OUT THE INVENTION

Preferred embodiments of a printer according the present invention will be described in detail with reference to the accompanying drawings.

(Outer Appearance of Printer)

Figure 1:
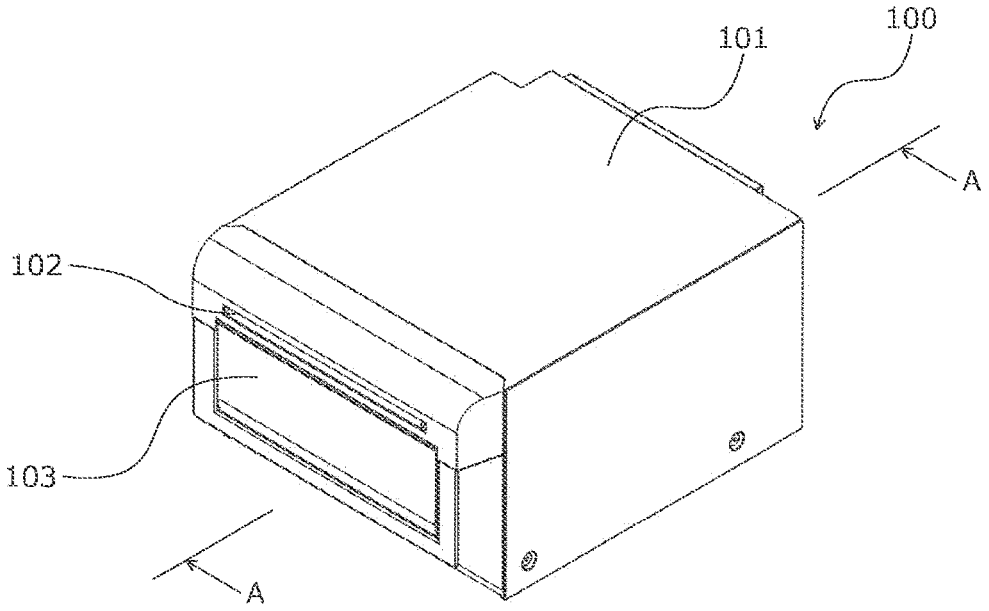
FIG. 1 is an explanatory diagram of an outer appearance of a printer of an embodiment according to the present invention.

The outer appearance of the printer of an embodiment according to the present invention will be described. FIG. 1 is an explanatory diagram of the outer appearance of the printer of the embodiment according to the present invention. In FIG. 1, the printer 100 of the embodiment according to the present invention includes a substantially box-shaped housing 101. A discharge outlet 102 that discharges a recording medium for which a recording operation is executed by the printer 100 is disposed at a front of the housing 101.

A guiding member 103 is disposed in front of the housing 101 and beneath the discharge outlet 102. The guiding member 103 has a substantially plate-like shape and is disposed integrally with a cutting waste collecting box (see FIG. 2) that is detachably attached to the housing 101.

(Internal Configuration of Printer 100)

Figure 2:
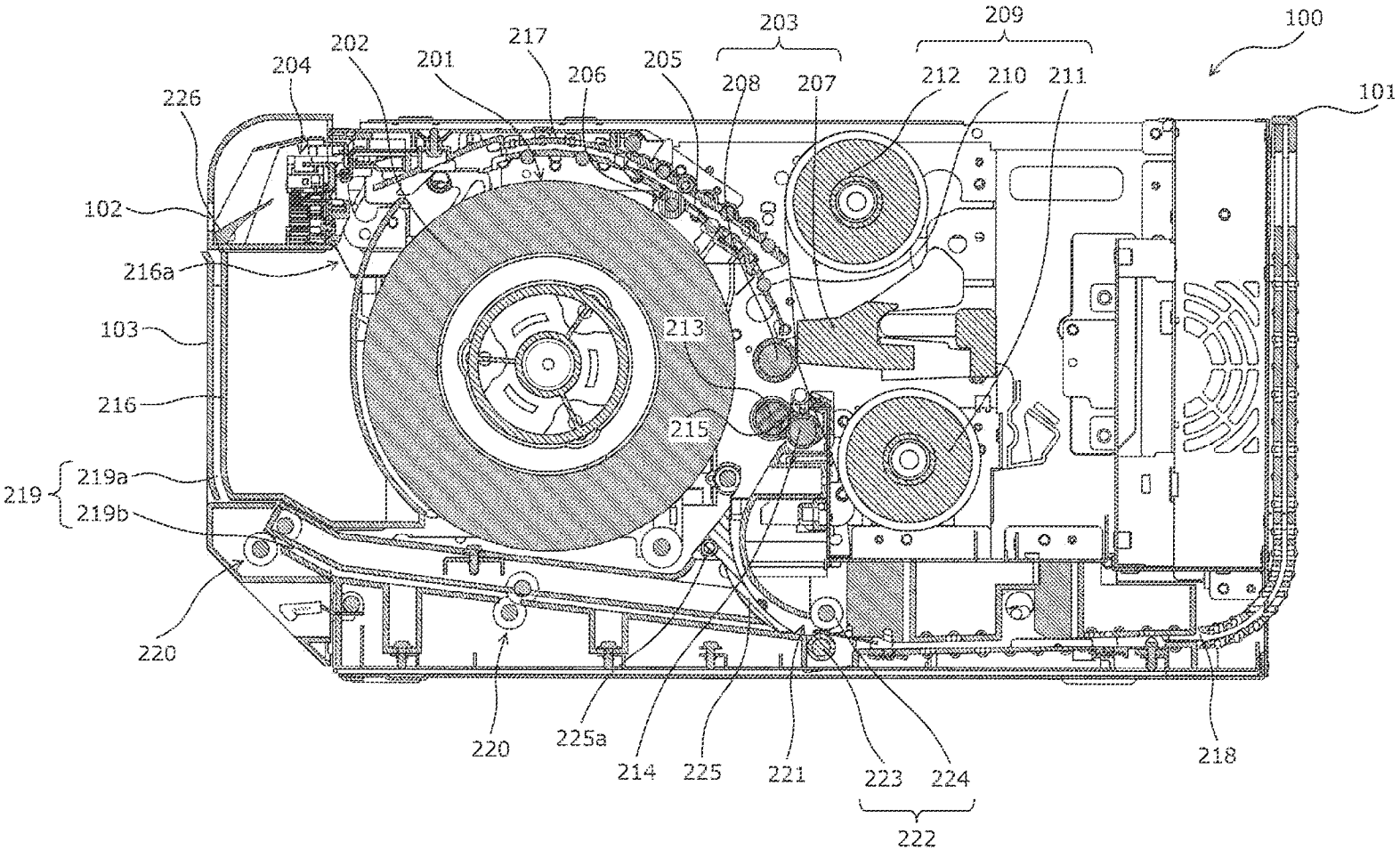
FIG. 2 is an A-A cross-sectional diagram of FIG. 1.

An internal configuration of the printer 100 of the embodiment according to the present invention will be described. FIG. 2 is an A-A cross-sectional diagram of FIG. 1. In FIG. 2, the printer 100 includes, in the housing 101, a recording medium holding unit 201 that holds a recording medium 202 to be recorded on. The recording medium holding unit 201 holds the recording medium 202 that is wound thereon in a roll. The recording medium holding unit 201 holds an outer circumferential portion of the long strip-like recording medium 202 that is wound thereon in a roll, from beneath of the recording medium.

The recording medium holding unit 201 holds, in a rotatable manner, the recording medium 202 that is wound in a roll in the recording medium holding unit 201. The recording medium holding unit 201 holds, in a rotatable manner, a shaft of the recording medium 202 wound in a roll and thereby holds the recording medium in a rotatable manner. The recording medium holding unit 201 is coupled with a recording medium conveyance motor (see FIG. 3) through a predetermined gear train, and rotates the shaft of the recording medium using a driving force of the recording medium conveyance motor transmitted through the predetermined gear train. The recording medium holding unit 201 rotates selectively in a direction to pull out (unreel) the recording medium from the recording medium holding unit 201 and a direction to draw the recording medium into the recording medium holding unit 201.

The recording medium includes a recording layer. The recording layer included in the recording medium is disposed on the surface of a base material formed by a paper sheet or the like. The recording layer includes a heat-insulating layer that is applied or bonded to the base material and a receiving layer that is stacked on the heat-insulating layer. In the recording medium, the recording layer is disposed on both sides of the base material. For the printer 100, a recording medium is usable that has a recording layer disposed only on one side of the base material.

In the housing 101, a first conveyance path 205 is disposed, spanning from a pulling-out position of the recording medium in the recording medium holding unit 201 to the discharge outlet 102, sequentially through a recording unit 203 and the cutter mechanism 204. In the first conveyance path 205, a conveyance roller 206 that conveys the recording medium held by the recording medium holding unit 201 to the recording unit 203 may be disposed between the recording medium holding unit 201 and the recording unit 203.

The recording unit 203 includes a thermal head 207 and a platen 208. The thermal head 207 and the platen 208 are disposed to face each other with the first conveyance path 205 therebetween. The thermal head 207 is disposed to be movable to a position to be in contact with the platen 208 and a position to become separated from the platen 208.

The thermal head 207 includes plural heat-generating elements (heat-generating resisters) arranged in a line along a width direction of the recording medium, and a driver IC that drives the heat-generating elements. The driver IC is driven and controlled by a microcomputer included in the printer 100. The driver IC is driven and controlled by the microcomputer to selectively energize electrode wires connected from a power source not depicted to the heat-generating elements in the thermal head 207, and thereby causes the heat-generating elements corresponding to the energized electrode wires to generate heat.

The platen 208 has a cylinder-like shape and a direction along a shaft center thereof is the width direction of the recording medium; the platen 208 is disposed to be rotatable around the shaft center. The platen 208 is disposed to be rotatable in a counterclockwise direction (the forward direction) in FIG. 2 and a clockwise direction (the backward direction) in FIG. 2. The platen 208 receives pressure applied to the recording medium by the thermal head 207 that faces the platen 208 sandwiching the recording medium therebetween.

The recording unit 203 also includes a ribbon unit 209. The ribbon unit 209 includes a pair of ribbon cores 211 and 212 that hold an ink ribbon 210. The pair of ribbon cores 211 and 212 hold the ink ribbon 210 so that the ink ribbon 210 is stretched between the thermal head 207 and the platen 208. The pair of ribbon cores 211 and 212 hold the ink ribbon 210 in a state where an ink layer in the ink ribbon 210 faces the platen 208 between the thermal head 207 and the platen 208.

The pair of ribbon cores 211 and 212 are constituted by the take-up ribbon core 211 and the supply ribbon core 212. The take-up ribbon core 211 is disposed to be rotatable in the clockwise direction in FIG. 2, and rotates to thereby reel up the ink ribbon 210 held by the supply ribbon core 212, starting with one end of the ink ribbon 210. The supply ribbon core 212 holds the long, wound, strip-like ink ribbon 210 thereon, the supply ribbon core 212 holding the ink ribbon 210 so that the ink ribbon can be unreeled from an outer circumference side of the ink ribbon 210. The supply ribbon core 212 rotates in the clockwise direction in FIG. 2 associated with the winding up of the ink ribbon 210 due to the rotation of the take-up ribbon core 211, and unreels the ink ribbon 210 from the outer circumference side thereof.

The ink ribbon 210 held by the ribbon unit 209 includes a long strip-like base material and ink layers disposed on one face side of the base material. For example, the ink ribbon 210 includes ink layers for colors including yellow (Y), magenta (M), and cyan (C). Each of the ink layers is formed by a sublimation dye ink (an ink including a sublimation dye (a sublimation pigment), that is, a sublimation ink).

In the ink ribbon 210, the ink layers for plural colors are periodically arranged along the length direction of the base material for each of the colors. For example, the ink layers of yellow (Y), magenta (M), and cyan (C) are periodically arranged in order of "the ink layer for yellow (Y)→the ink layer for magenta (M)→the ink layer for cyan (C)→ . . . " along the length direction of the base material.

The ink ribbon 210 includes an overcoat layer. The overcoat layer is, together with the ink layers, periodically arranged along the length direction of the base material. For example, in the ink ribbon 210, the layers are periodically arranged in order of "the ink layer for yellow (Y)→the ink layer for magenta (M)→the ink layer for cyan (C)→the overcoat layer→the ink layer for yellow (Y)→ . . . " along the length direction of the base material.

The printer 100 executes a recording operation of a sublimation transfer scheme. The recording operation according to the sublimation transfer scheme is executed by causing the heat-generating elements to selectively generate heat by selectively energizing the heat-generating elements in the thermal head 207, transmitting the heat generated by the heat-generating elements to the ink ribbon 210, and transferring, by sublimation, the sublimation dye ink included in the ink layer included in the ink ribbon 210 to the receiving layer in the recording medium, whereby the recording layer in the recording medium is recorded on.

The printer 100 can adjust the density of the ink to be transferred to the recording medium for each dot that is to be recorded by executing the recording operation according to the sublimation transfer scheme. The printer 100, which executes the recording operation according to the sublimation transfer scheme, is therefore excellent in gradation expression. Because the printer 100 executes the recording operation according to the sublimation transfer scheme and can present excellent gradation expression, image quality that is sufficiently usable for printing a photograph can be obtained. The printer 100, which executes the recording operation according to the sublimation transfer scheme is called, for example, "dye-sublimation printer".

In the recording operation, the printer 100 applies a lamination process to the surface (the recording face) of the recording medium for which the recording operation is executed, by disposing the overcoat layer to cover the recording face. As a result, degradation of the water-resistant performance and weathering-resistant performance of the sublimation dye ink in the recorded article can be suppressed and the water-resistant performance and the weathering-resistant performance of the recorded article can be enhanced. When the recording operation is executed for each of the sides of the recording medium, the overcoat layer is disposed in each recording operation for each one side.

A gripping roller 213 and a pinch roller 214 are disposed in the housing 101. The gripping roller 213 and the pinch roller 214 are arranged to face each other sandwiching the first conveyance path 205 therebetween. Along the first conveyance path 205, the gripping roller 213 and the pinch roller 214 are disposed closer toward the recording medium holding unit 201 than the recording unit 203.

The gripping roller 213 is disposed on the back side of the recording face of the recording medium during the recording operation. The pinch roller 214 is urged in the direction to abut the gripping roller 213 that is disposed facing the pinch roller 214. The recording medium conveyed in the first conveyance path 205 can thereby be held sandwiched in a nipping portion 215 where the gripping roller 213 and the pinch roller 214 abut each other.

The gripping roller 213 includes a protrusion (not depicted) that protrudes in an outer circumference direction, thereby enabling slipping to be prevented between the gripping roller 213 and the recording medium. The force (the gripping force) for the gripping roller 213 and the pinch roller 214 to be able to hold and sandwich the recording medium therebetween and convey the recording medium is secured to be larger sufficiently than the loads received by the recording medium from the recording unit 203 and the first conveyance path 205. Slipping can thereby be reliably prevented between the gripping roller 213 and the recording medium.

The gripping roller 213 is coupled with the recording medium conveyance motor (see FIG. 3) through a predetermined gear train. The gripping roller 213 can thereby be rotated in a state where the recording medium is held sandwiched between the gripping roller 213 and the pinch roller 214. The gripping roller 213 is rotated in the state where the recording medium is held being sandwiched between the gripping roller 213 and the pinch roller 214, and the position of the recording medium can thereby be controlled relative to the position for the recording by the recording unit 203.

In the housing 101, near the gripping roller 213, a recording medium detection sensor (see FIG. 3) is disposed that detects the front end position of the recording medium pulled out from the recording medium holding unit 201 to the first conveyance path 205. For example, the recording medium detection sensor can be realized by an optical sensor that includes a light-emitting element and a light-receiving element disposed to face each other sandwiching the first conveyance path 205 therebetween and whose output varies corresponding to variation of the amount of the light received by the light-receiving element.

The amount of the light received by the light-receiving element is varied as a consequence of the light emitted by the light-emitting element being blocked when the recording medium conveyed in the first conveyance path 205 passes between the light-emitting element and the light-receiving element. The printer 100 can detect the front end position of the recording medium pulled out from the recording medium holding unit 201 to the first conveyance path 205 based on the output value of the recording medium detection sensor, the output value varying corresponding to the variation of the amount of the light received by the light-receiving element. In this manner, the recording position for each of the colors relative to the recording medium can be aligned with high precision by disposing the recording medium detection sensor near the gripping roller 213 and a high quality recorded article can be obtained.

The cutter mechanism 204 is disposed near the discharge outlet 102. The cutter mechanism 204 includes a fixed blade whose position is fixed and a movable blade disposed to be movable (able to reciprocate) in the width direction of the recording medium along the fixed blade. The movable blade is in contact with the fixed blade and is disposed at a position to sever the first conveyance path 205. The movable blade has a circular plate-like shape in which the blade is included in the outer circumferential portion thereof, the moveable blade being disposed to be movable (able to reciprocate) in the width direction of the recording medium along the fixed blade. The movable blade is disposed at a position such that the passage of the recording medium is not obstructed when no operation is executed such as when the movable blade stands by to cut the recording medium.

The cutter mechanism 204 includes a driving source such as a movable blade driving motor, a power transmission mechanism (not depicted) that transmits the driving force generated by the movable blade driving motor to the movable blade, and the like. The cutter mechanism 204 cuts the recording medium by moving the movable blade along the width direction of the recording medium using the driving force generated by the movable blade driving motor in a state where a position for cutting (that is, the position to be cut at) of the recording medium is conveyed to the position (i.e., the position for the cutting by the cutter mechanism 204) at which the movable blade moves (reciprocates) crossing the first conveyance path 205 in the first conveyance path 205.

In the housing 101, near the position for the cutting by the cutter mechanism 204, a cutting position detecting sensor is disposed whose output value varies corresponding to a presence or absence of the recording medium. For example, similar to the recording medium detecting sensor, the cutting position detecting sensor includes a light-emitting element and a light-receiving element that are disposed to face each other sandwiching the first conveyance path 205 therebetween, and can be realized by an optical sensor that varies corresponding to variation of the amount of the light received by the light-receiving element.

The cutting waste collecting box 216 is disposed on the lower side of the cutter mechanism 204 in the vertical direction, in the housing 101. The cutting waste collecting box 216 is a member that includes an opening **216*a* on the upper side thereof and that has a bottomed box-like shape, and accommodates through the opening 216*a* the cut pieces (the cutting waste) produced in the recording operation for the recording medium by the printer 100**.

The guiding member 103 is disposed integrally with the cutting waste collecting box 216, in front of the cutting waste collecting box 216. The guiding member 103 is disposed integrally with the cutting waste collecting box 216 in a state where the guiding member 103 is separated from the front side of the cutting waste collecting box 216 by a predetermined distance. The guiding member 103, together with the cutting waste collecting box 216, constitute a path **219*a* that is a portion of the second conveyance path 219**.

The cutting waste collecting box 216 can be detached from the housing 101 and attached to the housing 101.

The guiding member 103 guides the position of the recording medium conveyed in the path 219*a* of the second conveyance path 219 such that the recording medium passes in front of the cutting waste collecting box 216 along the cutting waste collecting box 216. The recording medium can be conveyed in front of the cutting waste collecting box 216 (the printer 100) without increasing the size of the printer 100 by guiding the passage position of the recording medium that is conveyed in the path 219*a* by the guiding member 103.

For example, a portion of or the guiding member 103 overall may be formed using an optically transparent material. The guiding member 103 thereby functions like a window, and the recording medium conveyed in the inside of the housing 101 (the second conveyance path 219) can be recognized visually from the outside of the housing 101.

On the first conveyance path 205, a guiding member 217 is disposed that guides the position of the recording medium such that the recording medium to be recorded on is conveyed along the first conveyance path 205. The guiding member 217 guides the position of the recording medium such that the recording medium pulled out from the recording medium holding unit 201 passes by the recording unit 203 and is thereafter conveyed to the cutter mechanism 204. The guiding member 207 has a conveyance assisting member disposed thereon to smoothly convey the recording medium in the first conveyance path 205.

The conveyance assisting member includes, for example, a receiving portion that is disposed on the guiding member 217 and that has an arc-like shape, and rolling elements such as spheres or rollers fitted in the receiving portion. The first conveyance path 205 has a conveyance roller 206 pair disposed thereon. Of the conveyance roller 206 pair, at least one conveyance roller 206 is coupled with the recording medium conveyance motor through a predetermined gear train (neither is depicted).

In the housing 101, on the side closer to the discharge outlet 102 than the cutter mechanism 204, the second conveyance path 219 is disposed that branches from the first conveyance path 205 to reach the inversion path 218. The second conveyance path 219 spans from the branching position thereof from the first conveyance path 205 to the inversion path 218 passing through the side beneath the recording medium holding unit 201. The second conveyance path 219 includes the path 219*a* having one end thereof disposed at the branching position from the first conveyance path 205, and a path 219*b* having one end thereof connected to the other end of the path 219*a* and having the other end thereof connected to the inversion path 218. The path 219*b* has plural conveyance roller pairs 220 disposed therein.

The inversion path 218 is disposed to extend from the nipping portion 215 of the gripping roller 213 and the pinch roller 214 to the upper side along the wall face on the side opposite the recording medium holding unit 201 sandwiching the recording unit 203 therebetween passing through a vicinity of the lower face in the housing 101. In this embodiment, "the conveyance path leading to the inverting mechanism" according to the present invention is realized by the inversion path 218.

The second conveyance path 219 is connected to the inversion path 218 at a position in the inversion path 218. The inversion roller pair 222 is disposed at the connection point 221 of the second conveyance path 219 and the inversion path 218. One inversion roller 223 of the pair of inversion rollers 223 and 224 constituting the inversion roller pair 222 is coupled with the recording medium conveyance motor (see FIG. 3) through a predetermined gear train.

The one inversion roller 223 is rotated by transmitting thereto the driving force of the recording medium conveyance motor coupled thereto through the predetermined gear train. The one inversion roller 223 is disposed to be rotatable in the counterclockwise direction (a drawing direction) in FIG. 2 and the clockwise direction (an inversion direction) in FIG. 2, corresponding to the rotation direction of the recording medium conveyance motor coupled thereto through the predetermined gear train.

In the inversion path 218, an inversion guiding member 225 guiding the position of the recording medium conveyed from the inversion path 218 to the recording unit 203 is disposed between the inversion roller pair 222 and the nipping portion 215 of the gripping roller 213 and the pinch roller 214. The inversion guiding member 225 is a plate-like member that has a shape curved along the inversion path 218, and has one end thereof positioned at the connection position 221 of the second path 219 and the inversion path 218 and the other end thereof set to be able to swing around a fulcrum 225*a* disposed to be higher in the vertical direction than the one end thereof.

Around the fulcrum 225*a*, the inversion guiding member 225 swings between a position to connect the second conveyance path 219 and the inversion path 218 to each other and to close the nipping portion 215 and the connection point 221 of the second conveyance path 219 and the inversion path 218, and a position to close the second conveyance path 219 and open the inversion path 218. In the normal state, the inversion guiding member 225 is positioned at the position to close the second conveyance path 219 and open the inversion path 218 by an urging force of an urging member. In this embodiment, an inversion mechanism realizing an inverting unit according to the present invention is constituted by the inversion path 218, the inversion roller pair 222, the inversion guiding member 225, and the like.

A switching flap 226 is disposed closer toward the recording unit 203 than the discharge outlet 102 in the first conveyance path 205. The switching flap 226 is coupled with a switching flap driving motor (see FIG. 3) through a predetermined gear train, and is selectively positioned at a position to connect the position for the cutting by the cutter mechanism 204 and the inversion mechanism to each other, by the driving force of the switching flap driving motor transmitted thereto through the predetermined gear train. In this embodiment, a switching unit according to the present invention is realized by the switching flap 226.

(Hardware Configuration of Printer 100)

Figure 3:
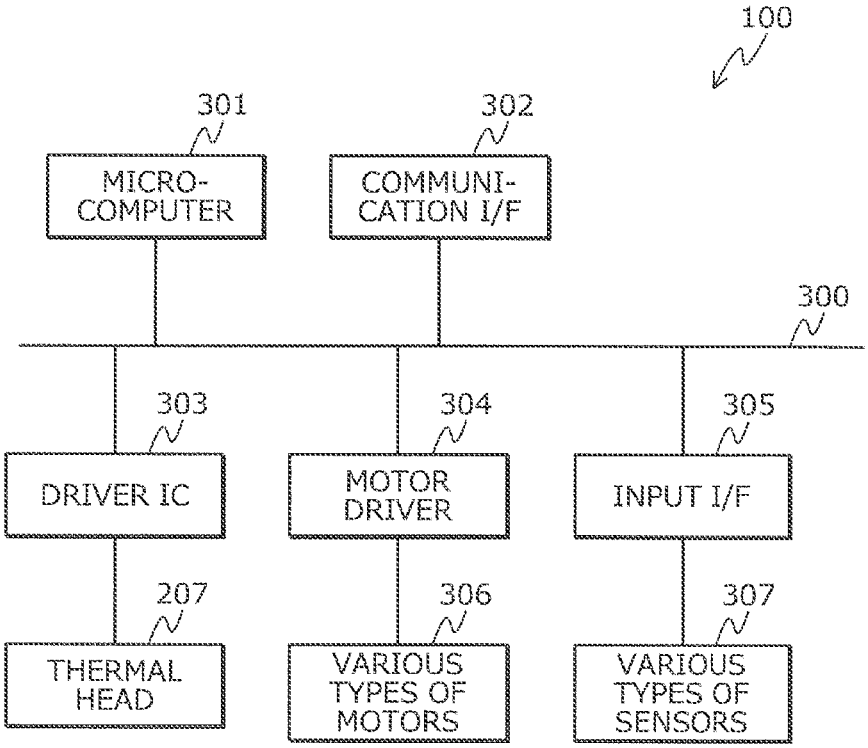
FIG. 3 is an explanatory diagram of a hardware configuration of a printer 100 of the embodiment according to the present invention.
Figure 4:
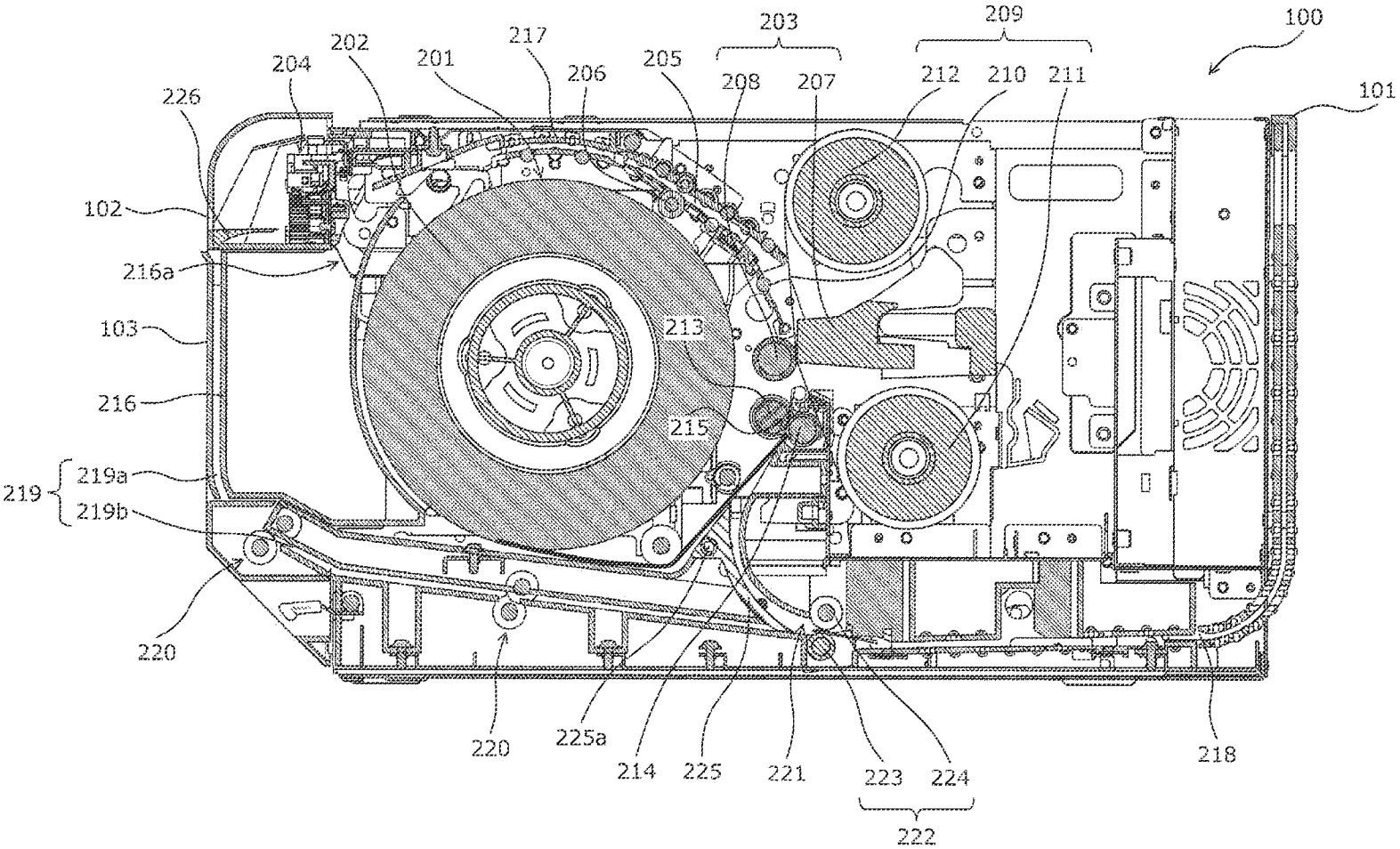
FIG. 4 is an explanatory diagram (part 1) of a recording operation according to a single-side recording of recording operations executed by the printer 100 of the embodiment according to the present invention.
Figure 5:
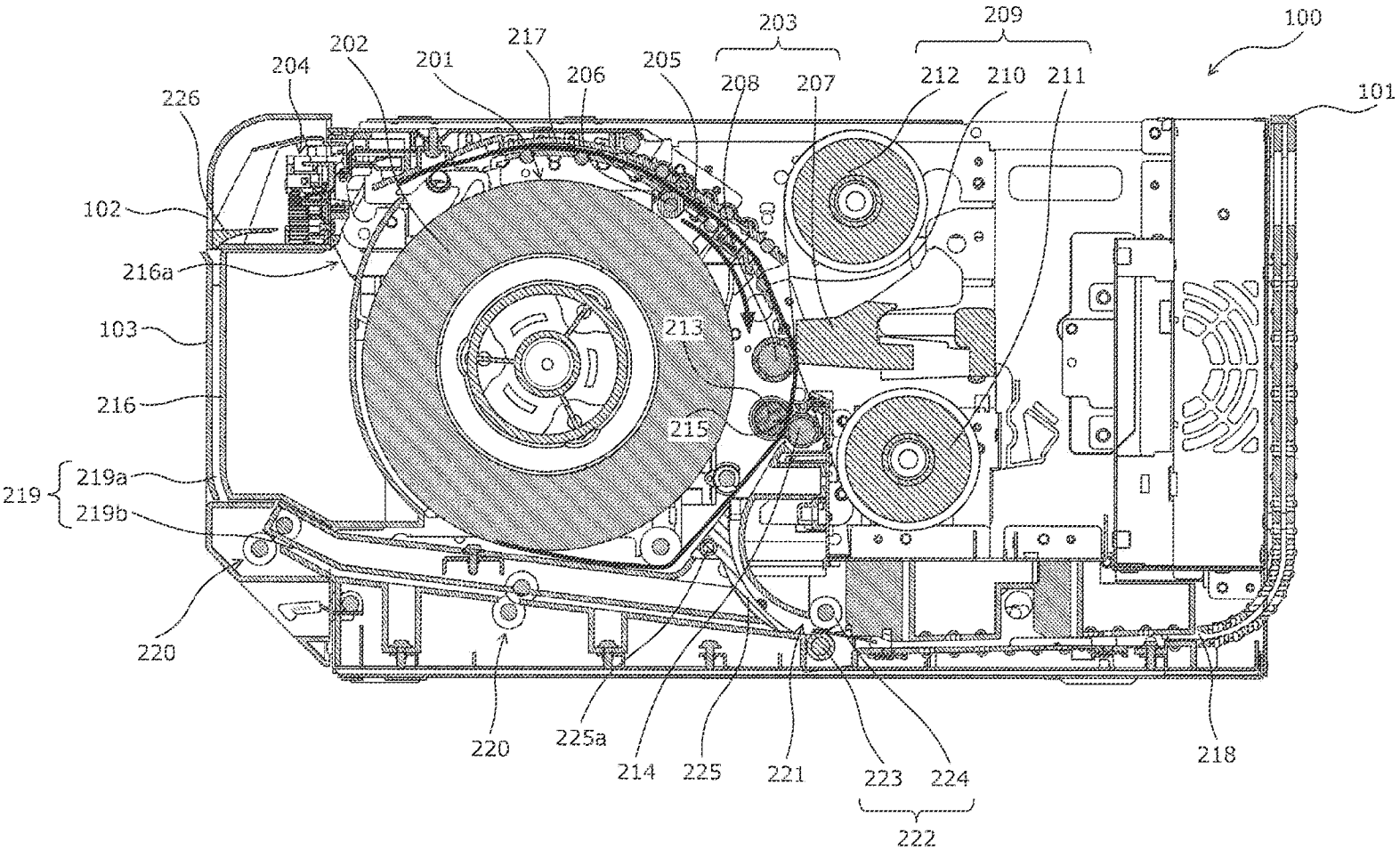
FIG. 5 is an explanatory diagram (part 2) of the recording operation according to the single-side recording of the recording operations executed by the printer 100 of the embodiment according to the present invention.
Figure 6:
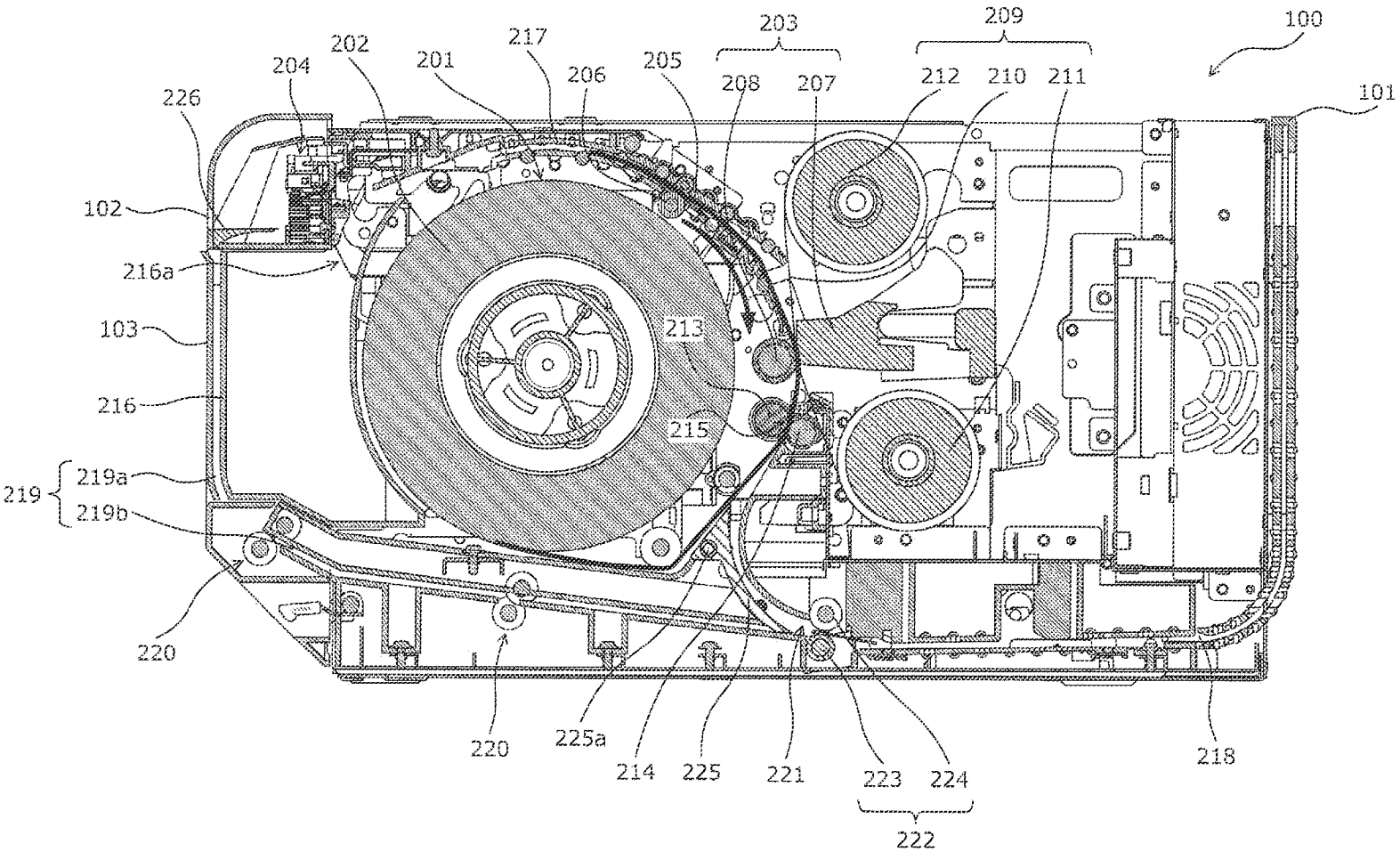
FIG. 6 is an explanatory diagram (part 3) of the recording operation according to the single-side recording of the recording operations executed by the printer 100 of the embodiment according to the present invention.

A hardware configuration of the printer 100 of the embodiment according to the present invention will be described. FIG. 3 is an explanatory diagram of the hardware configuration of the printer 100 of the embodiment according to the present invention. In FIG. 3, the printer 100 includes a microcomputer 301, a communication interface (I/F) 302, a driver IC 303, a motor driver 304, and an input I/F 305. The components of the microcomputer 301, the communication I/F 302, the driver IC 303, the motor driver 304, and the input I/F 305 are connected to each other by a bus 300.

The microcomputer 301 drives and controls the components included in the printer 100. The microcomputer 301 can be realized by, for example, a circuit board that has various types of circuits mounted thereon such as a CPU, a memory such as a ROM or a RAM, input and output circuits, and a timer circuit.

The microcomputer 301 drives and controls the components included in the printer 100 by executing on the CPU, various types of control programs stored in the memory, based on various types of data stored in the memory included in the microcomputer 301 and various types of data received from an external apparatus not depicted through the communication I/F 302. In the microcomputer 301, the CPU uses, for example, the RAM as the work area for expanding image data necessary for the printing based on recording instruction information.

The communication I/F 302 is connected to an external apparatus not depicted. The communication I/F 302 may be connected directly to an external apparatus or may be connected thereto through a network. The communication I/F 302 supervises an internal interface with the external apparatus and controls the input and the output of data for the printer 100.

For example, the external apparatus produces a recording instruction for the printer 100 and outputs the produced recording instruction to the printer 100. The external apparatus can be realized by, for example, a personal computer installed in a DPE stand that provides a service of outputting by printing, an image shot by a digital camera.

The recording instruction includes, for example, information on an image and the like to be recorded on the recording medium, and a command instructing the recording of this information. For example, the external apparatus outputs, as a recording instruction, a single-side recording instruction instructing a recording operation for the one side of the recording medium (single-side recording) or a double-side recording instruction instructing the recording operations for both sides of the recording medium (double-side recording).

The driver IC 303 is driven and controlled by the microcomputer 301. The driver IC 303 is driven and controlled by the microcomputer 301 and thereby selectively energizes the electrode wires corresponding to the plural heat-generating elements included in the thermal head 207 in the recording unit 203. The heat-generating elements can thereby be selectively caused to generate heat. The heat generated by the heat-generating elements of the thermal head 207 is transmitted to the recording layer of the recording medium through the ink ribbon 210, the sublimation dye ink disposed in the ink ribbon 210 is thereby transferred, by sublimation, to the recording medium, enabling the recording operation to be executed for the recording medium.

The motor driver 304 is driven and controlled by the microcomputer 301. The motor driver 304 is connected to various types of motors 306 such as the recording medium conveyance motor that is coupled with the gripping rollers 213, the conveyance roller pair 220, the inversion roller pair 222, and the like, the movable blade driving motor in the cutter mechanism 204, and the switching flap driving motor coupled with the switching flap 226. The motor driver 304 drives and controls the various types of motor 306 connected to the motor driver 304, based on control signals from the microcomputer 301.

The input I/F 305 is connected to various types of sensors 307 included in the printer 100 such as the recording medium detection sensor. The various types of sensors 307 may be connected to the input I/F 305 using a universal serial bus (USB). The input I/F 305 outputs signals that correspond to the output values from the various types of sensors 307 to the microcomputer 301. The microcomputer 301 drives and controls the components included in the printer 100 based on the signals output from the input I/F 305.

(Recording Operation Executed by Printer 100)

A recording operation executed by the printer 100 of the embodiment according to the present invention will be described. As described, the printer 100 can execute the single-side recording and the double-side recording for the recording medium.

(Single-Side Recording)

A recording operation according to the single-side recording will be described as a recording operation executed by the printer 100. FIG. 4 to FIG. 7 are explanatory diagrams each of the recording operation according to the single-side recording of the recording operations executed by the printer 100 of the embodiment according to the present invention.

For the single-side recording, the printer 100 first receives a single-side recording instruction from an external apparatus. The printer 100 having received the single-side recording instruction, rotates the shaft of the recording medium in the recording medium holding unit 201 to pull out the recording medium held by the recording medium holding unit 201 to the first conveyance path 205 (see FIG. 4). The printer 100 positions the switching flap 226 at the position to connect the position for the cutting by the cutter mechanism 204 and the discharge outlet 102 to each other. The printer 100 can detect that the front end position of the recording medium pulled out from the recording medium holding unit 201 to the first conveyance path 205 reaches the nipping portion 215, based on the output value of the recording medium detecting sensor.

The printer 100 rotates the gripping roller 213 and the platen 208 in addition to the conveyance roller 206 in the forward rotation direction based on the detected front end position of the recording medium. The printer 100 rotates the conveyance roller 206 and the gripping roller 213 in the forward rotation direction until the front end position of the recording medium whose front end position is detected reaches a preset start position of the recording operation (a recording start position) (see FIG. 5).

The start position of the recording operation (the recording start position) can be set at a position such that a length from the front end of the recording medium pulled out to the first conveyance path 205 to the recording position of the recording unit 203 is longer than a dimension of the recorded article identified based on the single-side recording instruction received from the external apparatus. When the long strip-like recording medium is pulled out from the recording medium holding unit 201, the printer 100 brings the thermal head 207 to be separated from the platen 208.

The thermal head 207 is moved to the side of the platen 208 so that the recording medium and the ink ribbon 210 are held being sandwiched by the thermal head 207 and the platen 208. In this state, the heat-generating elements included in the thermal head 207 are selectively heated based on the single-side recording instruction (see FIG. 6) while the long strip-like recording medium pulled out from the recording medium holding unit 201 is conveyed to the first conveyance path 205 in the direction to draw the recording medium into the recording medium holding unit 201 (the direction indicated by an arrow in FIG. 6). As a result, the heat generated by the heat-generating elements included in the thermal head 207 is transmitted to the ink ribbon 210, and the sublimation dye ink disposed on the ink ribbon 210 is sublimation-transferred to the recording medium, whereby the recording operation can be executed for the recording medium.

In this recording operation, the printing is executed sequentially for the Y, M, and C faces for each of the colors of the ink layers. For example, a recording operation for the first color (for example, yellow (Y)) is executed, a recording operation for the second color (for example, magenta (M)) is executed next, and a recording operation for the third color (cyan (C)) is executed. Every time the printer 100 executes the recording operation for each of the colors, the printer 100 pulls out the recording medium to the first conveyance path 205 until the front end of the recording medium drawn into the recording medium holding unit 201 due to the recording operation again reaches the recording start position.

For example, after executing the recording operation for the first color (for example, yellow (Y)), the printer 100 pulls out the recording medium to the first conveyance path 205 until the front end of the recording medium reaches the recording start position. The printer 100 executes the recording operation for the second color (for example, magenta (M)) and, after executing the recording operation for the second color (for example, magenta (M)), the printer 100 pulls out the recording medium to the first conveyance path 205 until the front end of the recording medium reaches the recording start position. The printer 100 similarly executes the recording operation for the third color (cyan (C)).

After executing the recording operations for all the colors for the one side of the recording medium, the printer 100 disposes the overcoat layer on the recording face for which the recording operations are executed. In a state where the recording medium for which the recording operations are executed is pulled out to the first conveyance path 205 until the front end of the recording medium reaches the recording start position, the printer 100 executes the above recording operations and thereby disposes the overcoat layer on the recording face for which the recording operations are executed. The overcoat layer is disposed on the overall recording face for which the recording operations are executed.

The printer 100 drives and controls the corresponding motor driver 304 and thereby conveys the recording medium whose one side has the overcoat layer disposed thereon (hereinafter, properly referred to "recording medium for which the single-side recording is executed") to the side of the discharge outlet 102. The recording medium for which the single-side recording is executed is conveyed until the front end thereof passes through the position for the cutting by the cutter mechanism 204 and is pulled out to a predetermined position. For example, the recording medium is conveyed until the border between a non-recorded portion and the recorded portion toward the front end of the recording medium for which the single-side recording is executed reaches the position for the cutting by the cutter mechanism 204.

Figure 7:
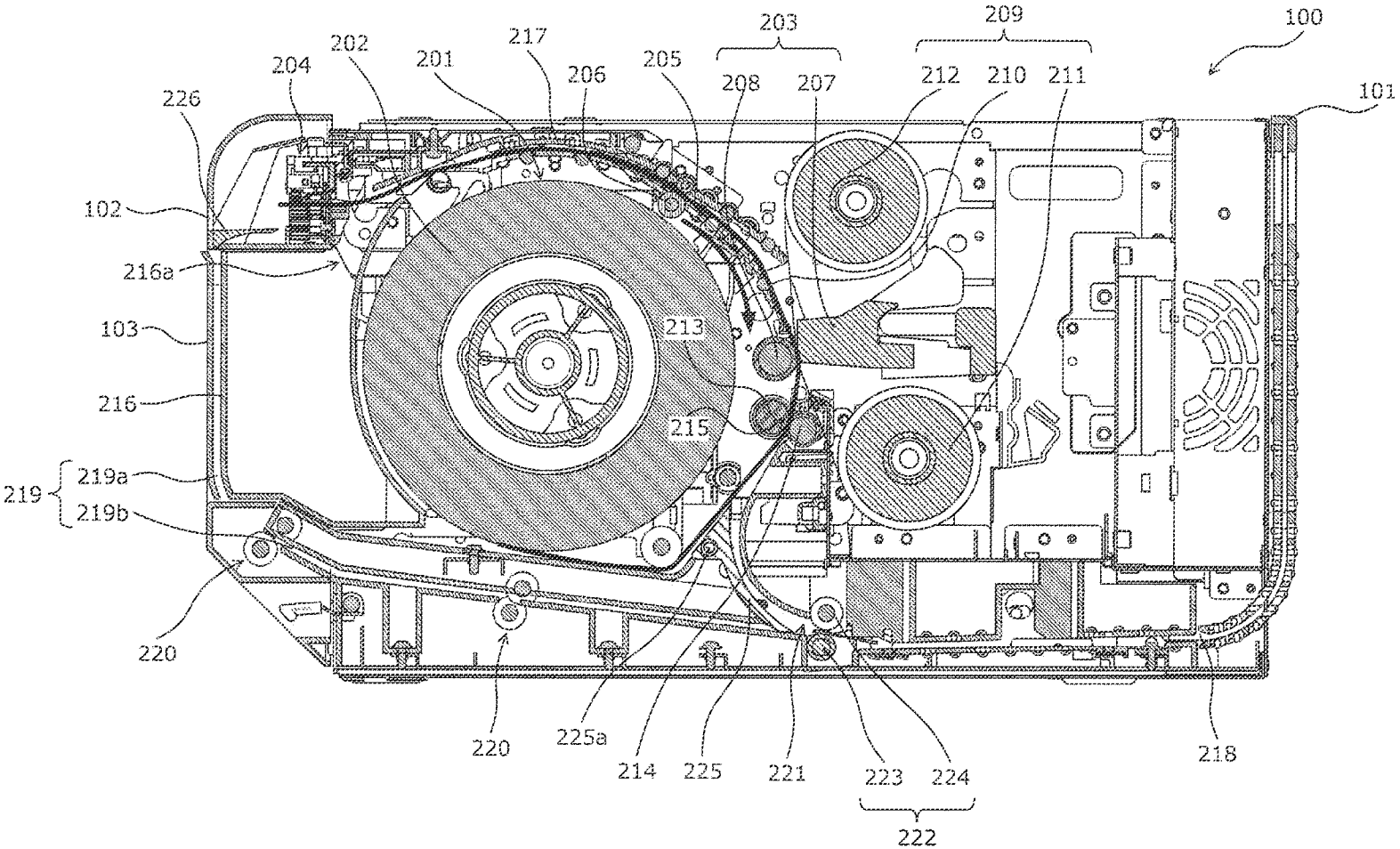
FIG. 7 is an explanatory diagram (part 4) of the recording operation according to the single-side recording of the recording operations executed by the printer 100 of the embodiment according to the present invention.
Figure 8:
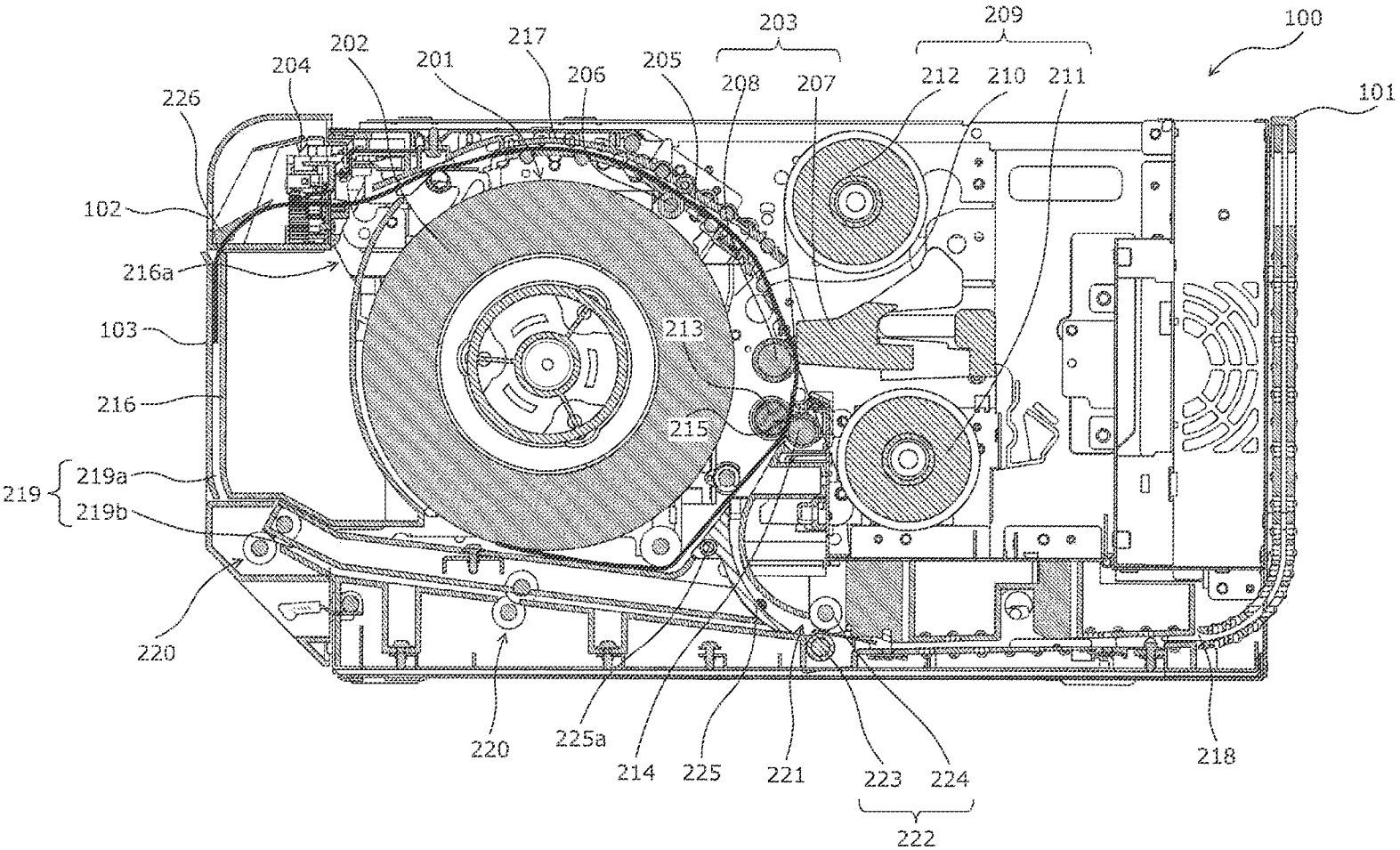
FIG. 8 is an explanatory diagram (part 1) of a recording operation according to a double-side recording of the recording operations executed by the printer 100 of the embodiment according to the present invention.

In a state where the border between the non-recorded portion and the recorded portion toward the front end of the recording medium for which the single-side recording is executed is positioned at the position for the cutting by the cutter mechanism 204, the printer 100 drives and controls the motor driver 304 of the movable blade motor in the cutter mechanism 204 to operate the movable blade (see FIG. 7). The margin spanning from the border between the non-recorded portion toward the front end and the recorded portion to the front end of the recording medium for which the single-side recording is executed is cut off from the recorded article. The margin piece produced by this cutting is accommodated in the cutting waste collecting box 216.

The recording medium for which the single-side recording is executed and whose margin at the front end is cut off is conveyed toward the discharge outlet 102. As to the recording medium for which the single-side recording is executed, the printer 100 drives and controls the corresponding motor driver 304 until the recording unit 203 portion of the recording medium passes through the position for the cutting by the cutter mechanism 204 and is conveyed to a predetermined position. For example, the printer 100 conveys the recording medium until the border between the non-recorded portion and the recorded portion on the recording medium holding unit 201 side of the recording medium for which the single-side recording is executed reaches the position for the cutting by the cutter mechanism 204.

In a state where the border between the non-recorded portion and the recorded portion on the recording medium holding unit 201 side of the recording medium for which the single-side recording is executed is positioned at the position for the cutting by the cutter mechanism 204, the printer 100 drives and controls the motor driver 304 of the movable blade motor in the cutter mechanism 204 to operate the movable blade. The border between the non-recorded portion and the recorded portion on the recording medium holding unit 201 side of the recording medium for which the single-side recording is executed is thereby cut and a back end of the recorded article is formed.

In this manner, a recorded article having no margin (a recorded article having no frame) can be provided by cutting both ends of the recorded part 203 of the recording medium for which the single-side recording is executed. The recording medium whose margins at both ends are cut off becomes a single sheet-like recording medium from the long strip-like recording medium. The printer 100 discharges the single sheet-like recording medium from the discharge outlet 102 to the exterior of the printer 100.

For each of the recording operations by the recording unit 203, the energy applied to the recording face of the recording medium during the recording operation (printing energy) can be adjusted by adjusting the amount of energization for the heat-generating elements included in the thermal head 207 (the energization time period), the conveyance velocity of the recording medium for the recording operation (the printing energy), and the like. The winding curl left in the recording medium can thereby be removed and a non-curved and flat recording medium can be obtained by using the long, wound, strip-like recording medium.

(Double-Side Recording)

The recording operation according to the double-side recording will be described as the recording operation executed by the printer 100. FIG. 8 to FIG. 13 are explanatory diagrams each of the recording operation according to the double-side recording of the recording operations executed by the printer 100 of the embodiment according to the present invention.

For the double-side recording, the printer 100 first receives a double-side recording instruction from an external apparatus. The printer 100 having received the recording instruction according to the double-side recording instruction, executes the recording operation for the one side of the recording medium held by the recording medium holding unit 201 to form a single sheet-like recording medium in the same manner as that of the single-side recording.

For the double-side recording, in a state where the printer 100 positions the switching flap 226 at the position to connect the position for the cutting by the cutter mechanism 204 and the inversion mechanism to each other, the printer 100 executes the single-side recording operation similar to the above single-side recording. For the double-side recording, the printer 100 does not cut a margin at the front end of the recording medium whose one side has the recording operation executed therefor. The recording medium whose one side has the recording operation executed therefor and that already passed through the cutter mechanism 204 is thereby conveyed to the second conveyance path 219 starting with the front end thereof (see FIG. 8).

At the timing at which the front end of the long strip-like recording medium 202 for which the single-side recording is executed passes through the cutter mechanism 204 and is pulled out by a predetermined length, the printer 100 drives and controls the motor driver 304 of the movable blade motor in the cutter mechanism 204 to operate the movable blade. For example, the printer 100 operates the movable blade at the timing at which the border between the non-recorded portion and the recorded portion on the side of the holding unit 201 (the side of the back end) of the recording medium whose one side has the recording operation executed therefor and that passes through the cutter mechanism 204, passes through the position for the cutting by the cutter mechanism 204 and the recording medium is thereafter further conveyed for the predetermined length.

Figure 9:
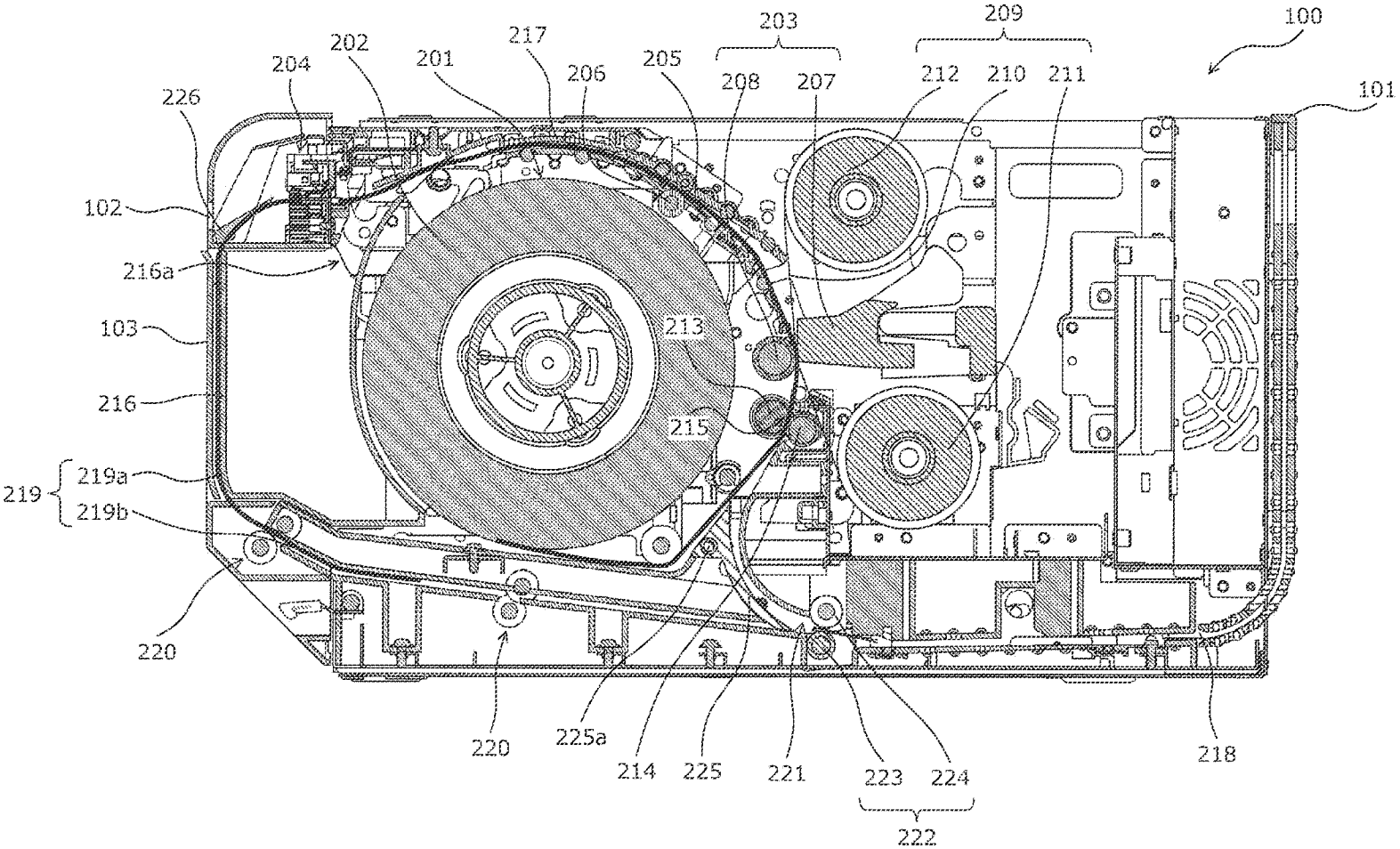
FIG. 9 is an explanatory diagram (part 2) of the recording operation according to the double-side recording of the recording operations executed by the printer 100 of the embodiment according to the present invention.

A single sheet-like recording medium is thereby formed that includes margins more outward than the border between the non-recorded portion and the recorded portion (on the front end side and the back end side) (see FIG. 9). The margins on the front end side and the back end side are disposed such that the length of the recording medium for which the single-side recording is executed is set to be a length that enables the other end of the recording medium to be held being sandwiched in the nipping portion 215 when the one end of the recording medium is positioned at the recording start position. The long strip-like recording medium 202 whose recorded portion is cut off is drawn back into the recording medium holding unit 201 to be ready for the next recording instruction.

Figure 10:
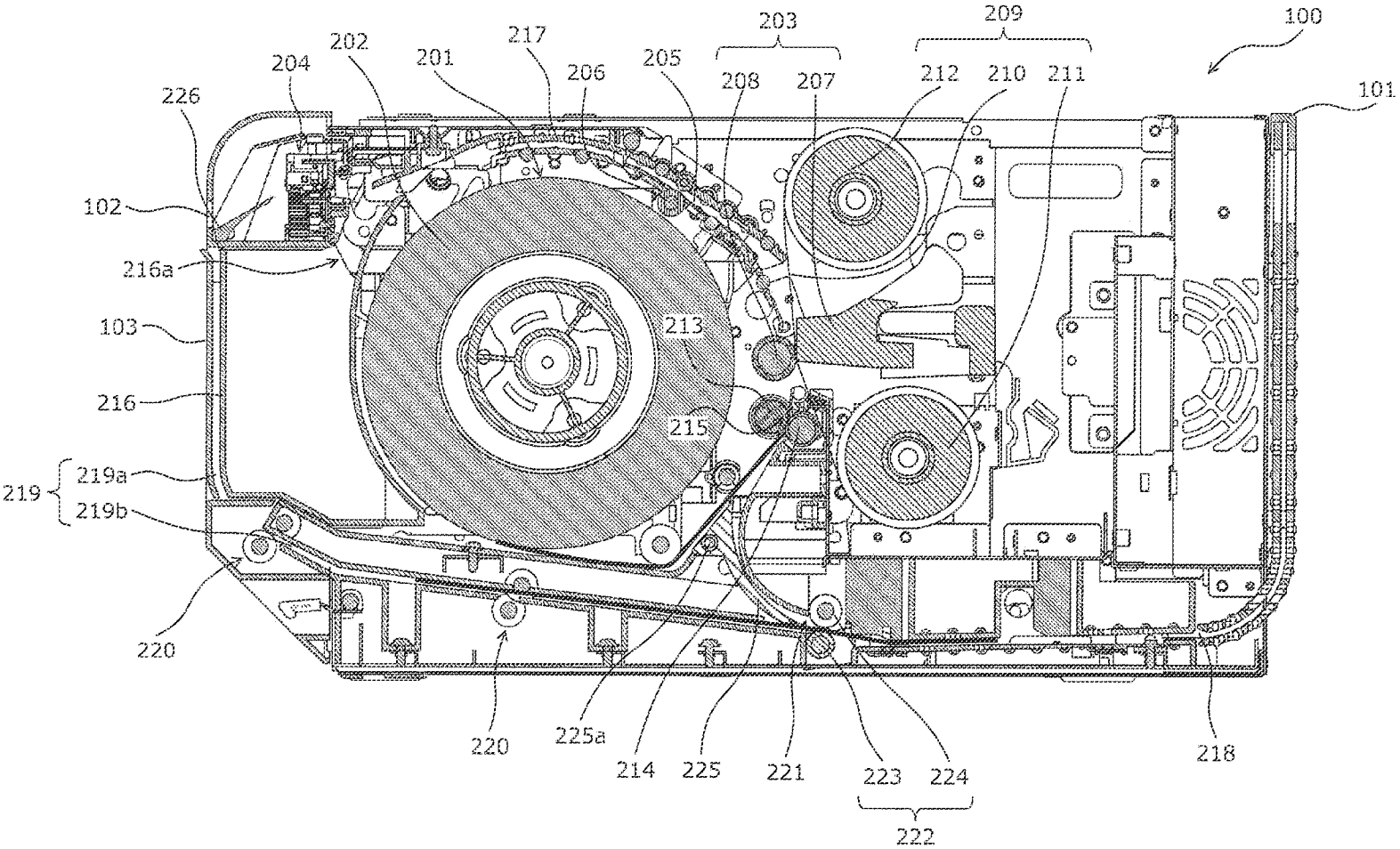
FIG. 10 is an explanatory diagram (part 3) of the recording operation according to the double-side recording of the recording operations executed by the printer 100 of the embodiment according to the present invention.

The recording medium for which the single-side recording is executed (the recording medium for which the single-side recording is executed) is conveyed to the inversion path 218 starting with the front end thereof, through the second conveyance path 219 (see FIG. 10). At this time, the inversion guiding member 225 normally positioned at the position to close the second conveyance path 219 and open the inversion path 218 by the urging force of the urging member is urged by the recording medium conveyed from the second conveyance path 219 to the inversion path 218 to thereby be swung around the fulcrum 225*a*, and is thereby positioned at the position to connect the second conveyance path 219 and the inversion path 218 to each other and close the nipping portion 215 and the connection position 221 of the second conveyance path 219 and the inversion path 218. The recording medium already passing through the cutter mechanism 204 is conveyed from the second conveyance path 219 to the inversion path 218.

At this time, the printer 100 drives and controls the corresponding motor driver 304 to rotate the one inversion roller 223 of the inversion roller pair 222 in the counter-clockwise direction (the drawing direction) in FIG. 10 until the back end of the recording medium for which the single-side recording is executed passes through the connection position of the inversion path 218 with the second conveyance path 219. The recording medium for which the single-side recording is executed is thereby completely drawn in the inversion path 218 starting with the front end thereof (see FIG. 11). The recording medium (the recording medium for which the single-side recording is executed) completely drawn in the inversion path 218 has its end portion on the back end side held and sandwiched by the inversion roller pair 222.

When the recording medium for which the single-side recording is executed is completely drawn in the inversion path 218, the urging for the inversion guiding member 225 by the recording medium conveyed from the second conveyance path 219 to the inversion path 218 is released and the inversion guiding member 225 is swung in the clockwise direction around the fulcrum 225*a* by the urging force of the urging member to be positioned at the position to close the second conveyance path 219 and open the inversion path 218.

Figure 11:
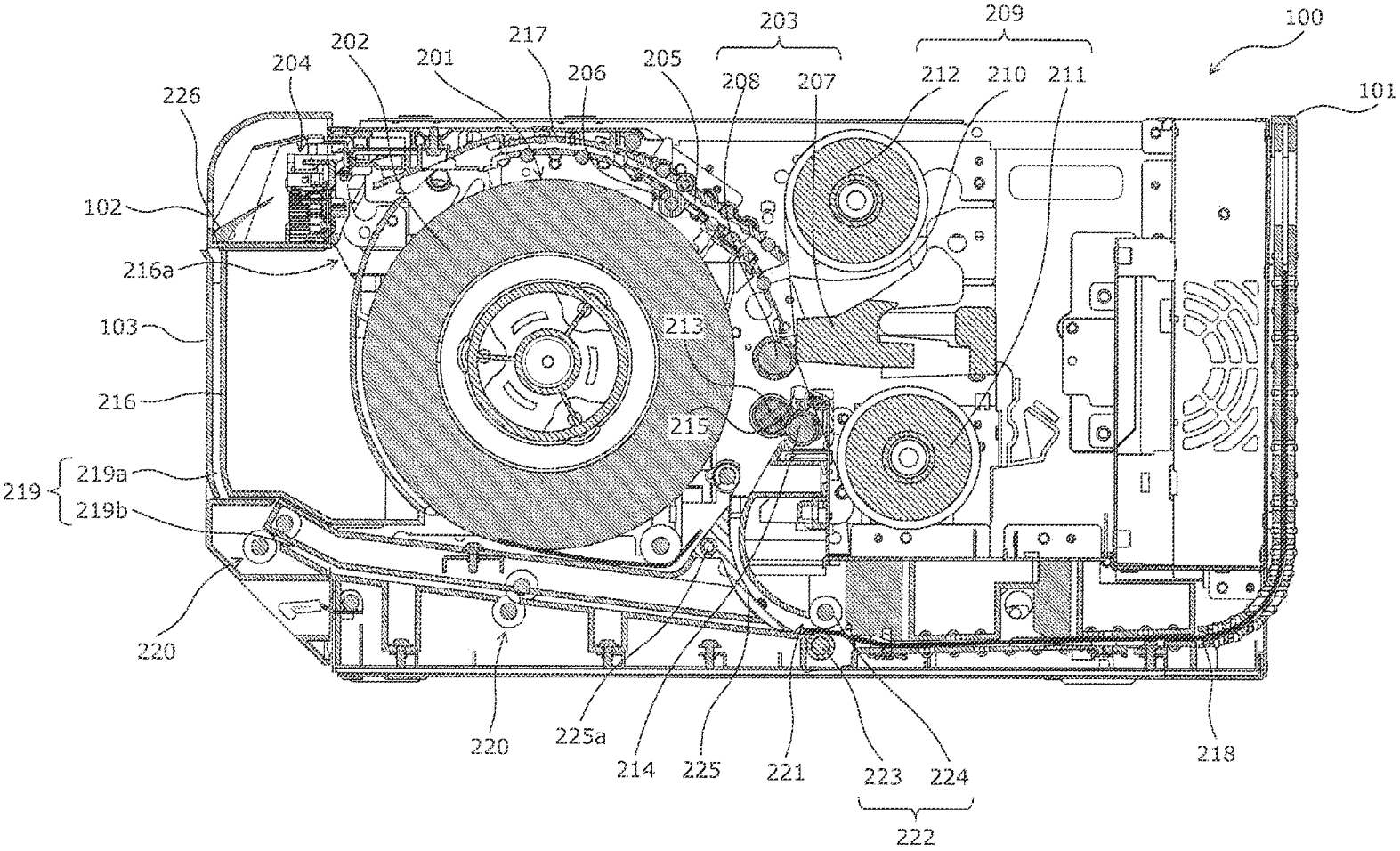
FIG. 11 is an explanatory diagram (part 4) of the recording operation according to the double-side recording of the recording operations executed by the printer 100 of the embodiment according to the present invention.

In the state where the recording medium for which the single-side recording is executed is completely drawn in the inversion path 218 and the inversion guiding member 225 is positioned at the position to close the second conveyance path 219 and open the inversion path 218, the printer 100 rotates the one inversion roller 223 of the inversion roller pair 222 in the clockwise direction (the backward rotation direction) in FIG. 11. The recording medium for which the single-side recording is executed and that is completely drawn in the inversion path 218 starting with the front end thereof has the end portion that is the back end when the recording medium is drawn into the inversion path 218 set to be a new front end thereof and is conveyed to the nipping portion 215 starting with the new front end. The front side and the back side of the recording medium relative to the position for the recording by the recording unit 203 can be inverted to each other.

The recording medium conveyed to the nipping portion 215 starting with the new front end thereof after being drawn in the inversion path 218 (the inverted recording medium) is guided along a curved face of the inversion guiding member 225. Abrupt bending of the recording medium can thereby be prevented and damage to the recording medium can also be prevented. The inversion guiding member 225 can be urged by the inverted recording medium such that the inversion guiding member 225 is positioned at the position to close the second conveyance path 219 and open the inversion path 218. Hooking of the inverted recording medium on the connection position 221 of the second conveyance path 219 and the inversion path 218, and conveyance thereof to the second conveyance path 219 can thereby reliably be prevented.

Figure 12:
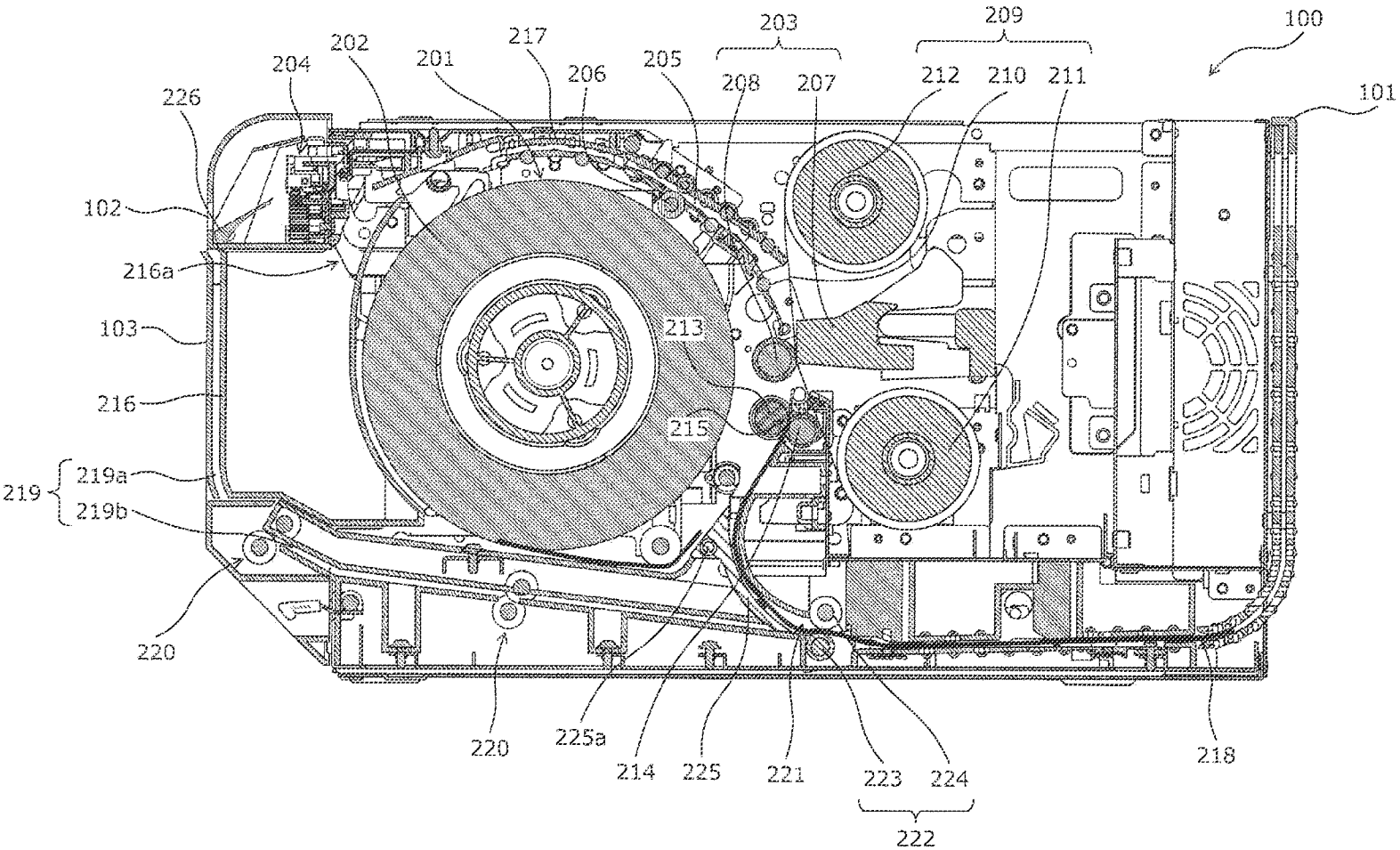
FIG. 12 is an explanatory diagram (part 5) of the recording operation according to the double-side recording of the recording operations executed by the printer 100 of the embodiment according to the present invention.
Figure 13:
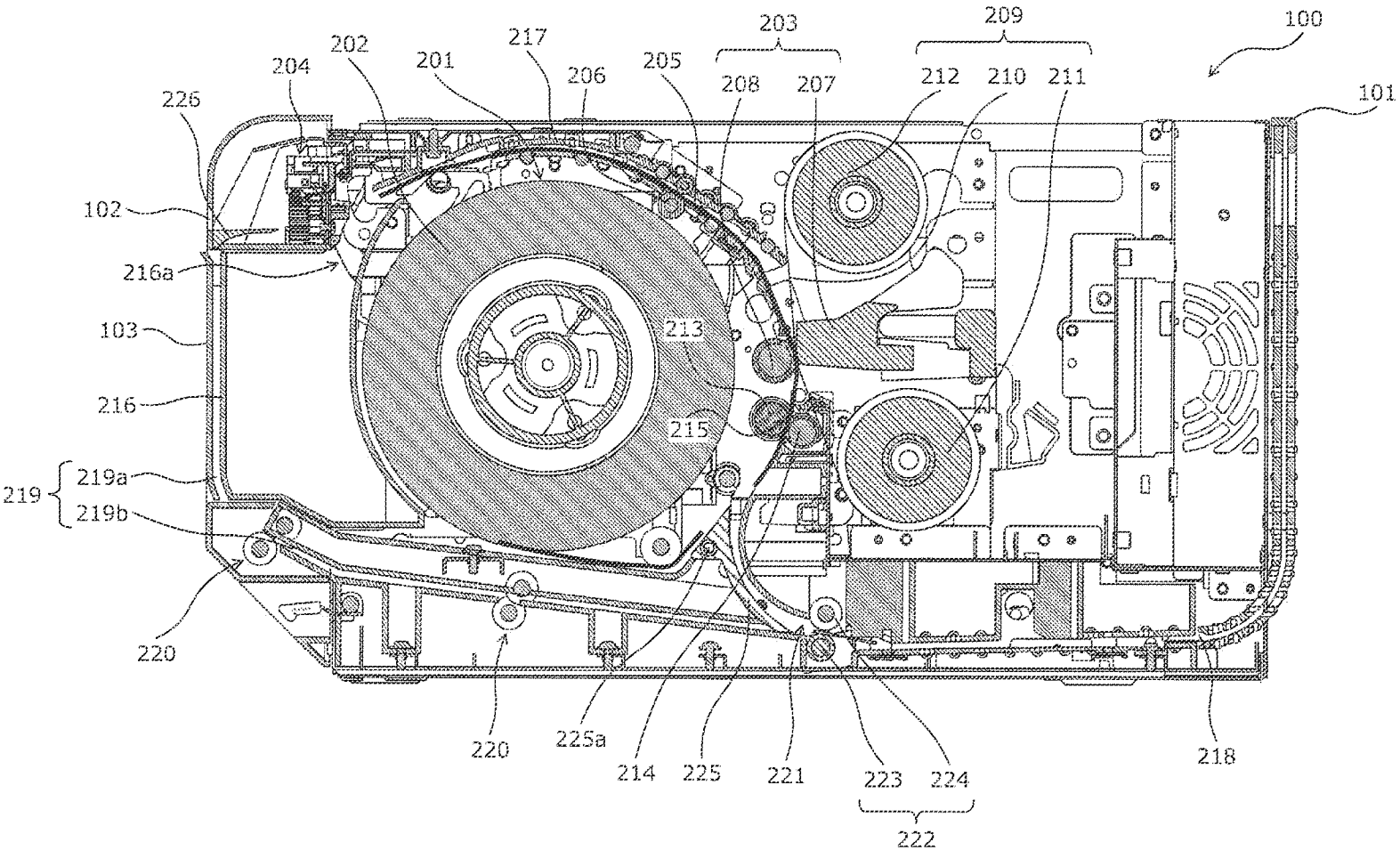
FIG. 13 is an explanatory diagram (part 6) of the recording operation according to the double-side recording of the recording operations executed by the printer 100 of the embodiment according to the present invention.

The printer 100 rotates the one inversion roller 223 of the inversion roller pair 222 in the backward rotation direction until the state is detected in which the new front end of the inverted recording medium (the back end of the recording medium before the inversion) reaches the nipping portion 215 (see FIG. 12). The printer 100 thereafter further rotates the one inversion roller 223 in the backward rotation direction and, based on the detected position of the front end, rotates the gripping roller 213 and the platen 208 in the forward rotation direction until the position of the new front end of the inverted recording medium reaches the recording start position (see FIG. 13). The printer 100 brings the thermal head 207 to be separated from the platen 208 until the new front end of the inverted recording medium reaches the recording start position.

After conveying the inverted recording medium to the recording start position, the printer 100 moves the thermal head 207 to the side of the platen 208 so that the thermal head 207 and the platen 208 hold and sandwich therebetween the recording medium and the ink ribbon 210. In this state, the printer 100 causes the heat-generating elements included in the thermal head 207 to selectively generate heat based on a back side recording instruction and conveys the inverted recording medium in the direction to draw the recording medium into the inversion path 218.

The heat generated by the heat-generating elements included in the thermal head 207 is transmitted to the ink ribbon 210 and the sublimation dye ink disposed on the ink ribbon 210 is sublimation-transferred to the recording medium, thereby enabling the recording operation to be performed for the recording medium. In the recording operation for the inverted recording medium, that is, the recording operation for the back side of the recording medium, printing is executed sequentially for the Y, M, and C faces for each of the colors of the ink layers similarly to the recording operation for the front face of the recording medium. After the execution of the recording operations for all the colors for the back side of the recording medium, an overcoat layer is disposed on the recording face of the inverted recording medium (the back side) similarly to the recording operation for the front side thereof. The overcoat layer is disposed on the overall face of the recording face for which the recording operation is executed (the back side).

The printer 100 drives and controls the corresponding motor driver 304 to convey the recording medium having the overcoat layers disposed on both sides thereof (hereinafter, properly referred to as "recording medium for which the double-side recording is executed") to the side of the discharge outlet 102. For the double-side recording, after the back end of the recording medium for which the single-side recording is executed passes through the position of the switching flap 226 and until the new front end reaches the cutter mechanism 204, the printer 100 positions the switching flap 226 at the position to connect the position for the cutting by the cutter mechanism 204 and the discharge outlet 102 to each other.

Thus, the recording medium for which the double-side recording is executed is conveyed to a predetermined position toward the discharge outlet 102 so that the new front end thereof passes through the position for the cutting by the cutter mechanism 204. For example, the recording medium is conveyed until the border between the non-recorded portion and the recorded portion on the side of the new front end of the recording medium for which the double-side recording is executed reaches the position for the cutting by the cutter mechanism 204.

In a state where the border between the non-recorded portion on the side of the front end and the recorded portion on the side of the new front end of the recording medium for which the double-side recording is executed is positioned at the position for the cutting by the cutter mechanism 204, the printer 100 drives and controls the motor driver 304 of the movable blade motor in the cutter mechanism 204 to operate the movable blade. The margin spanning from the border between the non-recorded portion and the recorded portion on the side of the new front end of the recording medium for which the double-side recording is executed to the new front end is thereby cut off from the recorded article. The margin piece produced by this cutting is accommodated in the cutting waste collecting box 216.

The recording medium whose margin on the side of the new front end thereof is cut off after the execution of the double-side recording is conveyed toward the discharge outlet 102. The printer 100 drives and controls the corresponding motor driver 304 until the recording medium for which the double-side recording is executed is conveyed to a predetermined position after the recorded portion of the recording medium passes through the position for the cutting by the cutter mechanism 204. For example, the printer 100 conveys the recording medium until the border between the non-recorded portion and the recorded portion on the side of the new back end of the recording medium for which the double-side recording is executed reaches the position for the cutting by the cutter mechanism 204.

In a state where the printer 100 positions the border between the non-recorded portion and the recorded portion on the recording medium holding unit 201 side of the recording medium for which the double-side recording is executed, at the position for the cutting by the cutter mechanism 204, the printer 100 drives and controls the motor driver 304 of the movable blade motor in the cutter mechanism 204 to operate the movable blade. The border between the non-recorded portion and the recorded portion on the recording medium holding unit 201 side of the recording medium for which the double-side recording is executed is thereby cut. The margin piece produced by this cutting is accommodated in the cutting waste collecting box 216.

A recorded article having no margin (a recorded article having no frame) can be provided by cutting both ends of the recorded part 203 of the recording medium for which the double-side recording is executed as above. The recording medium whose margins at both ends are cut off becomes a single sheet-like recording medium from the long strip-like recording medium. The printer 100 discharges the single sheet-like recording medium from the discharge outlet 102 to the exterior of the printer 100.

As described above, the printer 100 of the embodiment according to the present invention is characterized in that the printer 100 includes the recording medium holding unit 201 that holds the long, wound, strip-like recording medium to enable the recording medium to be pulled out starting with the outer circumference side; the recording unit 203 that pulls out the recording medium held by the recording medium holding unit 201 and that executes the recording operation for the pulled-out recording medium; the cutter mechanism 204 as the cutting unit that cuts the predetermined position of the recording medium for which the recording operation is executed by the recording unit 203, at the position for the cutting disposed on the side closer to the recording unit 203 than the discharge outlet 102 to be the discharge position for discharging the recording medium; the inversion mechanism as the inverting unit that inverts the front side and the back side to each other relative to the position for the recording by the recording unit 203, of the recording medium for which the recording operation is executed by the recording unit 203; and the switching flap 226 as the switching unit that switches the conveyance destination of the recording medium that passes through the position for the cutting by the cutter mechanism 204 to the inversion mechanism or the discharge outlet 102.

As described above, to execute the recording operation by the single recording unit for both sides of the long strip-like recording medium using the recording medium, the front side and the back side of the recording medium need to be inverted to each other and, to invert the front side and the back side of the recording medium to each other, the long strip-like recording medium needs to be cut off after the recording operation is executed for the front side and before the recording operation is executed for the back side.

To ensure precision of the position for the recording, the recording medium needs to be firmly gripped to avoid displacement of the position of the recording medium during the recording operation. So that gripping marks caused thereby on the recording medium do not remain on the recording medium after the recording operation, a margin portion outside the print range needs to be gripped during the recording operation and the margin portion needs to be cut off after the recording operation is executed.

As described, to execute the recording operation by the single recording unit 203 for both sides of the long strip-like recording medium using the recording medium, the two cutting sessions are necessary for the cutting for the inversion and the cutting for removing the margin.

In contrast, according to the printer 100 of the embodiment of the present invention, the margin of the recording medium whose one side has the recording operation executed therefor and the margin of the recording medium whose both sides each have the recording operation executed therefor can be cut by the single cutter mechanism 204. The structure of the printer 100 can thereby be simplified compared to the case where the cutter mechanisms 204 are disposed for each of the cutting sessions. The occurrence of jamming can thereby be suppressed and, even when jamming occurs, the work to solve the jamming can be executed easily.

According to the printer 100 of the embodiment of the present invention, the cutter mechanisms 204 are susceptible to jamming due to the paper pieces produced by the cutting can be reduced compared to the case where the cutter mechanisms 204 are disposed for each of the cutting sessions. The occurrence of jamming can thereby be suppressed and, even when jamming occurs, the work to solve the jamming can easily be executed.

As described, according to the printer 100 of the embodiment of the present invention, the occurrence of jamming can be suppressed and, even when jamming occurs, the work to solve the jamming can be executed easily, enabling improvement of the convenience for the worker to be facilitated.

The printer 100 of the embodiment according to the present invention is characterized in that the printer 100 includes the housing 101 that accommodates the recording medium holding unit 201, the recording unit 203, the cutter mechanism 204, the inversion mechanism, and the switching flap 226, and the cutter mechanism 204 is disposed near the discharge outlet 102.

According to the printer 100 of the embodiment of the present invention, by disposing the cutter mechanism 204 near the discharge position, the execution of work can be facilitated for the cutter mechanism 204, which tends to jam due to the paper pieces and the like produced by the cutting and for which maintenance frequency is high such as for removing of the paper pieces. Improvement of the convenience for the worker can thereby be facilitated.

The printer 100 of the embodiment according to the present invention is characterized in that the switching flap 226 is disposed at a position closer to the outside of the housing 101 than the cutter mechanism 204.

According to the printer 100 of the embodiment of the present invention, the switching flap 226, which is susceptible to jamming because the switching flap 226 switches the conveyance direction of the recording medium to the direction toward the inversion mechanism or the discharge position, is disposed at a position closer to the outside of the housing 101 than the cutter mechanism 204, enabling the work to resolve jamming to be executed without having to touch the cutter mechanism 204, which requires caution when working with to avoid contact and danger. The safety of the worker can thereby be secured.

According to the printer 100 of the embodiment of the present invention, restrictions such as performing the work while avoiding the cutter mechanism 204 to avoid touching the cutter mechanism 204 can be eliminated and access to the point where jamming has occurred is facilitated. Execution of the work to resolve the jamming is therefore facilitated. Improvement of the convenience for the worker can thereby be facilitated.

As described, according to the printer 100 of the embodiment of the present invention, the safety of the worker can be secured and improvement of the convenience for the worker can be facilitated.

The printer 100 of the embodiment according to the present invention is characterized in that the printer 100 includes the inversion path 218; the inversion path 218 is arranged to span from the position for the cutting by the cutter mechanism 204 to the inversion mechanism passing through the side that is lower in the vertical direction than the recording medium held by the recording medium holding unit 201 and lower than the conveyance path of the recording medium from the recording medium holding unit 201 to the recording unit 203; and the conveyance destination of the recording medium is switched to the inversion mechanism by guiding the recording medium to pass through the position for the cutting to the inversion path 218 by the switching flap 226.

According to the printer 100 of the embodiment of the present invention, the conveyance path of the recording medium from the recording medium holding unit 201 to the recording unit 203 and the conveyance path of the recording medium from the position for the cutting to the inversion mechanism do not cross each other or overlap with each other. The recording operations can therefore be executed for both sides of the recording medium without disposing a mechanism that distinguishes whether the recording medium is for executing the recording operation for the front side thereof or the recording medium is for executing the recording operation for the back side thereof, or a complicated mechanism to convey the distinguished recording medium to the next process step. The structure of the printer 100 can thereby be simplified and the occurrence of jamming can be suppressed.

According to the printer 100 of the embodiment of the present invention, even when jamming occurs, the work to resolve the jamming can be executed easily by simplifying the structure of the printer 100.

INDUSTRIAL APPLICABILITY

As above, the printer according to the present invention is useful for a printer capable of executing recording to both sides of the recording medium, and is especially suitable for a printer that executes recording to both sides of a long strip-like recording medium using the recording medium.

EXPLANATIONS OF LETTERS OR NUMERALS

100 printer
101 housing
102 discharge outlet
201 recording medium holding unit
203 recording unit
204 cutter mechanism
205 first conveyance path
207 thermal head
208 platen
209 ribbon unit
210 ink ribbon
213 gripping roller
214 pinch roller

218 inversion path
219 second conveyance path
222 inversion roller pair
223, 224 inversion rollers
226 switching flap

The invention claimed is:

1. A printer comprising:

a recording medium holding unit that holds a long, wound, strip-like recording medium to as to enable the recording medium to be pulled out starting with an outer circumference side thereof;

a recording unit that pulls out the recording medium held by the recording medium holding unit to execute a recording operation for the recording medium that is pulled out;

a cutting unit that cuts a predetermined position of the recording medium for which the recording operation is executed by the recording unit, the cutting unit being disposed between the recording unit than and a discharge position at which the recording medium is discharged;

an inverting unit that inverts relative to a position for the recording by the recording unit, a front side and a back side of the recording medium for which the recording operation is executed by the recording unit and conveys the recording medium to the recording unit; and a switching unit that switches a conveyance destination of the recording medium passing through the cutting position for cutting by the cutting unit, to the inversion unit or the discharge position.

2. The printer according to claim 1, further comprising a housing that accommodates therein the recording medium holding unit, the recording unit, the cutting unit, the inverting unit, and the switching unit, wherein the cutting unit is disposed near the discharge position at which the recording medium is discharged to an exterior of the housing.

3. The printer according to claim 2, wherein the switching unit is disposed at a position closer to an outer side of the housing than is the cutting unit.

4. The printer according to claim 1, further comprising a conveyance path that spans from the cutting position to the inverting unit, passes through a side that is lower in a vertical direction than the recording medium held by the recording medium holding unit and a conveyance path of the recording medium from the recording medium held by the recording medium holding unit to the recording unit, wherein the switching unit switches the conveyance destination of the recording medium to the inverting unit by guiding the recording medium passing through the cutting position, to the conveyance path.

* * * * *